US005752357A

United States Patent [19]

Piller

[11] Patent Number: 5,752,357

[45] Date of Patent: May 19, 1998

[54] METHOD FOR THE REVERSIBLY FIXING A COVERING TO A SUPPORTING SURFACE, AND PARTS AND MATERIALS SUITABLE FOR CARRYING OUT THE METHOD

[76] Inventor: Helmut Piller, Clara-Hätzler-Str. 5, D-8900 Augsburg, Germany

[21] Appl. No.: 638,571

[22] Filed: Jun. 5, 1995

Related U.S. Application Data

[63] Continuation of Ser. No. 87,720, filed as PCT/DE92/00864 Oct. 15, 1992 published as WO93/10319 May 27, 1993, abandoned.

[30] Foreign Application Priority Data

| | | | |
|---|---|---|---|
| Nov. 11, 1991 | [DE] | Germany | 41 36 860.6 |
| Nov. 22, 1991 | [WO] | WIPO | PCT/DE91/00922 |
| Jan. 20, 1992 | [DE] | Germany | 42 01 351.8 |
| Jun. 3, 1992 | [DE] | Germany | 42 18 285.9 |

[51] Int. Cl.[6] ..... E04F 15/16

[52] U.S. Cl. ..... 52/747.11; 52/DIG. 4; 52/390; 52/391; 52/746.1; 156/71; 156/310

[58] Field of Search ..... 52/220.1, 263, 52/746.1, 747.11, DIG. 4, 390, 391, 392; 156/71, 310

[56] References Cited

U.S. PATENT DOCUMENTS

| | | | |
|---|---|---|---|
| 3,087,832 | 4/1963 | Fogle | 52/DIG. 4 |
| 3,102,314 | 9/1963 | Alderfer | 52/DIG. 4 |
| 3,243,374 | 3/1966 | Gillard | 52/DIG. 4 |
| 3,341,996 | 9/1967 | Jones et al. | 52/DIG. 4 X |
| 3,378,974 | 4/1968 | Bush, Jr. | 52/DIG. 4 |
| 3,609,934 | 10/1971 | O'Carroll | 52/DIG. 4 |
| 3,629,756 | 12/1971 | Holtz | 52/DIG. 4 |
| 3,811,237 | 5/1974 | Bettinger | 52/263 X |
| 3,938,295 | 2/1976 | Tate | 52/747 |
| 4,883,503 | 11/1989 | Fish | 52/263 |
| 5,049,700 | 9/1991 | Kobayashi et al. | 52/263 X |
| 5,116,439 | 5/1992 | Raus | 52/746.1 X |
| 5,265,386 | 11/1993 | Mühlethaler | 52/263 X |
| 5,476,559 | 12/1995 | Chiro | 52/DIG. 4 X |

FOREIGN PATENT DOCUMENTS

| | | | |
|---|---|---|---|
| 1573492 | 8/1980 | United Kingdom | 52/DIG. 4 |

*Primary Examiner*—Carl D. Friedman
*Assistant Examiner*—Kevin D. Wilkens
*Attorney, Agent, or Firm*—Edwin D. Schindler

[57] ABSTRACT

A method for a temporary attachment of a covering on a base, for example, a floor covering or a wall covering, is disclosed. The method includes the steps of: treating a base for supporting a covering with a material containing a particulate subject to a magnetic attraction or a magnetically-attracting particulate; producing the covering for attachment to the base so that the covering contains a magnetically-attracting particulate material or a magnetic attraction particulate, the particulate of the covering being different from the particulate of the base so that the covering and the base are magnetically-attractable to one another; and, placing a side of the covering against the base so that the covering is temporarily attached to the base by magnetization and without an adhesive. A surfacer material or a precoat, which magnetically-attractable material, may also be applied to the base.

23 Claims, 1 Drawing Sheet

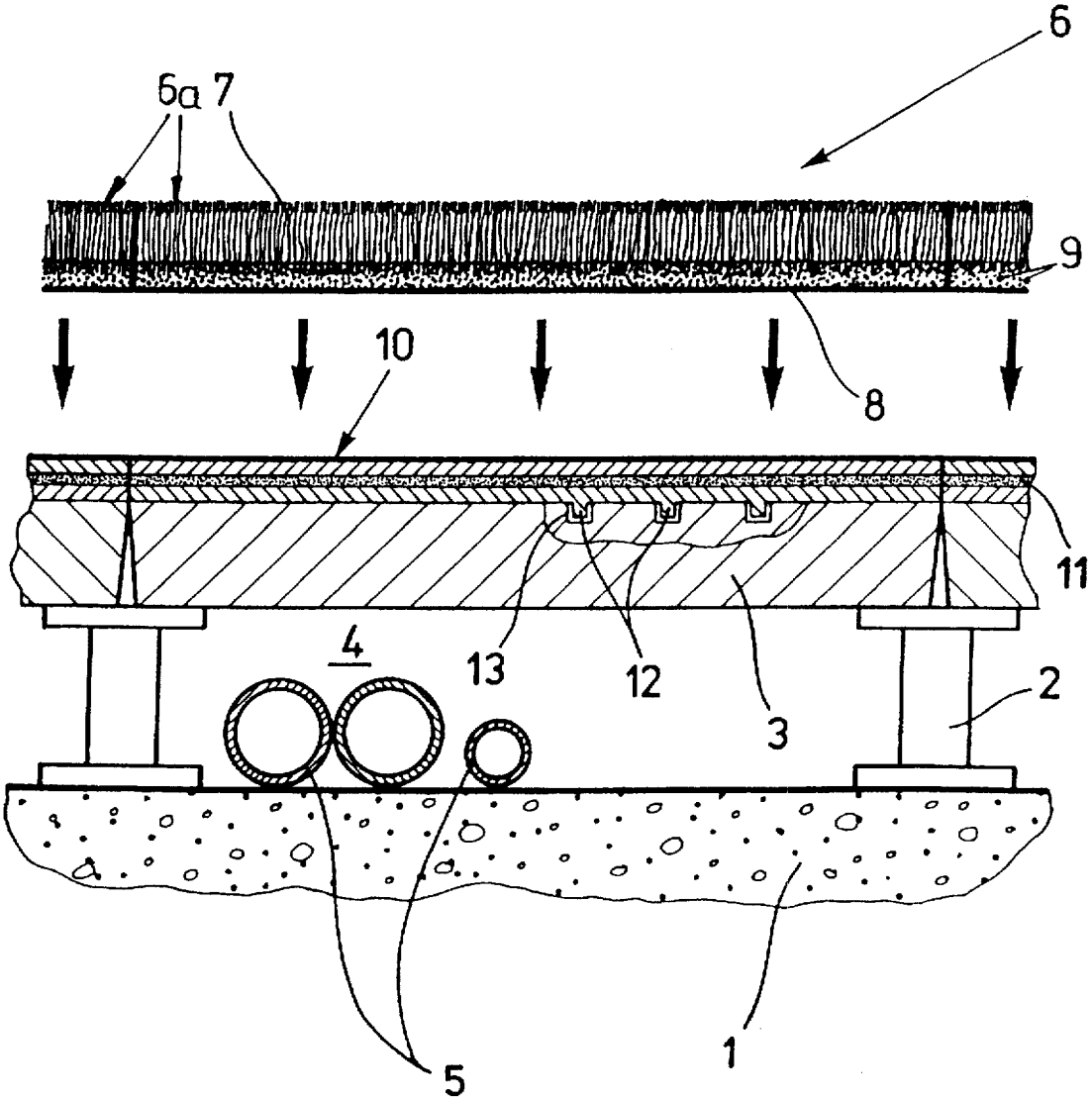
6
6a
7
9
8
10
11
4
13
12
3
2
5
1

METHOD FOR THE REVERSIBLY FIXING A COVERING TO A SUPPORTING SURFACE, AND PARTS AND MATERIALS SUITABLE FOR CARRYING OUT THE METHOD

This is a continuation of application Ser. No. 08/087,720, filed as PCT/DE92/00864 Oct. 15, 1992 published as WO93/10319 May 27, 1993, now abandoned.

BACKGROUND OF THE INVENTION

1. Technical Field of the Invention

The present invention relates to a method for the temporary attachment of a covering on a base, as well as parts and materials suitable for carrying out the inventive method.

2. Description of the Prior Art

A method of this type is known, see the German patent publication 2, 620,095 A1. In this case binding layers comprising iron or magnetic powder are applied to the covering and the base and are caused to cure prior to the attachment of the covering. This known method therefore leads to results which are unsatisfactory technically and economically, more particularly as regards the covering. In this respect it is namely to be assumed that the application of the binding material on the covering necessitates an additional working step following the production of the covering, something which leads to an undue increase in costs. A further, particularly serious disadvantage is to be seen in the fact that the binding material layer applied to the rear side of the covering leads to internal stresses within the covering and as a consequence there of to distortion such as so-called pits etc., something which is disadvantageous as regards the ability of the material to be attached and accuracy of attachment and therefore entails a reduction in quality.

SUMMARY OF THE INVENTION

Taking this a s a starting point one object of the present invention is to avoid the disadvantages of the known method using simple and low-cost means and to provide for highly economic performance of the method, for accuracy and furthermore for ease of attachment.

This object is attain ed in a surprisingly simple manner by the invention since at least during the production of the covering magnetically attracting or attractable particulate material is integrated in the material part thereof adjacent to the base.

During the production of a multi-layer covering with a support layer receiving at least one face layer it is preferred for the latter layer to be provided with the magnetically attracting or attractable particulate material.

These measures offer the advantage of rendering possible an integration of the application of the magnetic means of the covering in the inherently known production of the covering without any additional working step being necessary. In the case of fitted carpets or the like it is possible, instead of the particles so far embedded in the support layer and merely functioning to increase the weight per unit area to improve attachment properties, to simply integrate the magnetically attracting or attractable particles, something which does not make any further working operation necessary. Furthermore it is possible in this manner to automatically arrive at the desired area weight so that the covering in accordance with the invention is in any case able to be attached perfectly and remains in snug contact with any base on which it is arranged. Since the magnetically attracting or attractable particulate material is integrated in the covering or, respectively, in its support layer, there is the further advantage of being certain that internal stresses are not to be feared as a consequence of dimensional and geometrical changes. The measures in accordance with the invention accordingly lead to a high degree of accuracy and ease of attachment and therefore generally to a high quality and economic attachment.

The method in accordance with the invention may be universally applied and may be readily adapted to the circumstances of a given case. Thus in many cases it can be expedient to integrate the magnetically attracting particulate material in the support layer of the covering. This is more particularly true of a case in which the base consists of magnetically attracting material or, respectively, contains such a material, as is for example the case of a base provided with a casing of sheet steel. In the case of magnetically attracting materials provided for the covering, no further preliminary operations are necessary. To the extent that a base is encountered, which is magnetically neutral, the same is simply provided with a magnetically attracted or attracting means prior to attachment of the covering. In this respect it may in many cases turn out to be expedient simply to use magnetically attracted material in the covering so that in the covering, which is as a rule subjected to wear, the use of a low-cost material is ensured something which has a generally advantageous effect as regards the overall economics of the operation.

In order to prepare the base it is possible to simply utilize a web-like attachment sheet which contains a magnetically attracting or magnetically attractable particulate material and which may consist of foil, non-woven material, fabric or the like. In this respect it is convenient to use a two-layer attachment sheet, in the case of which the magnetically attracting or magnetically attractable particulate material is placed between the two layers and is secured by an adhesive or binding material. This ensures that even in the case of a comparatively small overall thickness a large quantity of particulate material may be accommodated. Such an attachment sheet will adhere, owing to its comparatively great weight, sufficiently reliably on the base and consequently has the advantage of being able to be attached in a loose state. However it would firstly be possible as well to connect the attachment sheet by means of an interlocking join and/or by means of an adhesive joint additionally to the base.

In accordance with a further advantageous development of the invention the base can be provided with a suitable surfacing material and/or a suitable precoat, it being convenient in this respect to integrate magnetically attractable particulate material, something which facilitates the get-ready operation in a simple manner and renders possible an even distribution of the magnetically active material throughout the entire volume. In this respect magnetically attracting particulate material is again provided on the covering.

In order to take into account the requirements in computer rooms and the like it is simply possible to render the means containing the magnetically attracting or magnetically attractable particulate material electrically conducting. In the case of the use of an attachment sheet the same may for this purpose simply be perforated and/or furnished with a conducting coating on all sides.

An other advantageous feature of the invention is such that even during the production of the base and more particularly during production of the double floor sheet members constituting the base, magnetically active particulate material is integrated in the material part adjacent to the surface. In this respect it may conveniently be a question of magnetically active particulate material so that adjacent to the covering, which is subjected to wear, it is possible to use the less expensive magnetically attractable material.

In the case of the production of double floors with double floor sheet members carried on supports it is possible for the covering and the means which magnetically attract each other and are on the covering and the double sheet members, to have them in alignment with the edges of the double floor sheet members, something which facilitates removing individual double floor sheet members.

As a magnetically attracting or magnetically attractable particulate material it is an advantage to use a powder-like material. The particle size may in this respect be advantageously so selected that there is no impairment of the covering and strength properties. Furthermore it is thus possible to achieve a good, even distribution of the material and a simple accommodation of a large quantity of particulate material.

As the magnetically attractable material it is simply possible to utilize ferromagnetic iron powder, which is available at an economic price. As the magnetically attracting material it is furthermore possible to utilize barium ferrite powder, which after application may be permanently magnetized, this being something which ensures simple processing.

BRIEF DESCRIPTION OF THE DRAWINGS FIGURE

In what follows one working embodiment of the invention will be described with reference to the drawing in more detail. The single FIGURE of the drawing shows a section taken through a covering in accordance with the invention with a base located underneath it in the form of a suitable double floor.

DETAILED DESCRIPTION OF THE DRAWING FIGURE AND PREFERRED EMBODIMENTS

The double floor depicted in the drawing consists of an underfloor structure 1, for example in the form of a concrete ceiling or the like, supports 2 mounted thereon and double floor sheet members 3 or boards resting thereon. The supports 2 mean that there is a cavity 4 between the underfloor structure 1 and the double floor sheet members 3 in order to accommodate installed means such as are indicated in the form of pipes 5. The double floor sheet members 3 may for instance be of chipboard, sheet metal, stone slabs, aerated concrete slabs or the like. In the depicted example chipboard is to be employed.

On the pre-existing double floor a covering 6 is laid which in the drawing may be seen to be arranged at a distance therefrom. This covering consists in the illustrated working embodiment of a plurality of tiles **6*a*, which are to be laid adjacent to each other and whose edges are aligned with the edges of the double floor sheet members 3 and which are so laid that edges in alignment with one another are produced. It is therefore possible in a simple manner to ensure that individual double floor sheet members 3 may be uncovered and removed in order to gain access to the cavity 4. It would however also be possible to lay the tiles 6*a* with an offset between their joints and the joints between double floor sheet members 3 in order to span any small inaccuracies in the thickness of the double floor sheet members 3**.

The covering 6 is here in the form of a fitted carpet covering. Accordingly the tiles **6*a* are in the form of fitted carpet tiles or panels. A fitted carpet of this type comprises a pile-like, textile upper layer 7 and a support layer 8** which secures the textile material in place and consists of a suitable material such as synthetic resin or the like.

In order to produce magnetic attraction between the covering 6 and the associated base, here in the form of the double floor sheet members 3, and consequently to ensure reliable adhesion despite easy removal, the covering with the associated base are furnished with means mutually magnetically attracting one another. These means are constituted by magnetically attracting or, respectively, magnetically attractable particulate material. In the illustrated working embodiment of the invention ferromagnetic iron powder 9 is incorporated in the support layer 8 of the covering 6. This powder is, as shown in the FIGURE, integrated in the support layer 8 with an even distribution in space. The double floor sheet members 3 constituting the base, which in the present case are to be in the form of chipboard, are in the illustrated working embodiment furnished with an attachment sheet 10, in which barium ferrite powder 11 is integrated, which after the putting in place in the layer sheet 10 may be permanently magnetized by the action of a magnetic field so that the ferromagnetic iron powder 9 of the covering 6 is attracted by it. However instead of barium ferrite it is possible furthermore to employ strontium ferrite or the like.

The layer sheet 10 consists, in the illustrated working embodiment, of a twin layer foil, between whose upper and lower layers a particulate material, in the present case in the form of the barium ferrite powder, is arranged and by means of an adhesive or a binding material is secured in place. However in lieu of a foil it would furthermore be possible to employ a non-woven material or a fabric or the like. In the case of a foil it is possible for the attachment sheet to be rendered electrically conducting ducting in a simple manner, that is to say by being furnished with an electrically conducting coating on all sides and/or provided with perforations distributed over its surface and able to be filled with conducting material. Instead of using attachment sheet 10, a precoat (alternatively designated by reference numeral 10) may be applied tot he applied.

The attachment sheet 10 which here as well has a tile-like form in a size corresponding to the floor sheet members 3 or, respectively, the tiles **6*a* on the covering side, may be loosely arranged on the associated base, which here is in the form of the double floor sheet members 3, something which means that the same may be readily removed again. The comparatively high area weight, resulting from the integrated metal powder, serves to ensure a reliable anchoring effect so that the sheeting keeps in place. In order to ensure that the parts are particularly firmly kept in place, it would naturally be possible for the attachment sheet 10 to be furthermore bonded to and/or interlocked with the associated base, for example by knobs 12 thereon, which would fit into detente holes 13 in the floor. In the installed condition there is practically no wear or only a very small degree of wear of the attachment sheet so underneath the covering 6, whereas the covering is subject to wear on its upper surface and consequently has to be replaced from time to time. Accordingly in the present case the cheaper iron powder 9 is used in the covering 6 and the more expensive barium ferrite powder is employed in the base, in the present case in the attachment sheet 10** on the base side. A reverse arrangement would naturally be possible. The incorporation of magnetically attracting material such as barium ferrite powder, which after incorporation can be permanently magnetized, in the covering will more particularly come into question if the associated base consists of ferromagnetic material, as for example will be the case with steel sheeting or, respectively, sheeting covered with steel sheet. The same will apply for base, in whose outer layer particulate material can be incorporated, this applying for instance for concrete slabs and the like. In such cases there is naturally no attachment sheet of the type illustrated here.

However instead of using an attachment sheet or integrating magnetically attracting or magnetically attractable particulate material in the base the same may simply be furnished with a precoat 10 and/or a surfacing material, there being therein a material which is suitable for causing magnetic attraction. In order to facilitate the stirring or mixing of the precoat or, respectively, of the surfacing material, in this case ferromagnetic iron powder is employed for this purpose. In the covering barium ferrite powder is accordingly to be utilized. The precoat and the surfacing material may be provided jointly. In many cases however the precoat alone can be sufficient. As a binding material it is in this respect convenient to employ an epoxy resin which cures quickly and gives a hard, wear-resistant surface, something that is more particularly an advantage, if the surface is exposed for long periods of time as is frequently the case on construction sites. The iron powder is preferably only stirred into the binding material, like the epoxy resin, on site.

In those cases in which corrosion of the iron powder or the like is likely to occur, the powder may be furnished with a suitable protective layer. For this purpose zinc stearate may be used. This material is mixed in a powder form into the iron powder or the like. Following this all the material is heated up to approximately 70° C. so that the zinc stearate fuses and forms the desired protective layer.

A preferred field of application for the coverings of the type in accordance with the invention is exhibition stands or booths, gymnasia or the like or removable coverings for floors underneath which cables etc. have been laid. However the advantages provided by the invention make themselves felt in connection with stair carpets and stair mats owing to the good slip-free attachment to the base.

I claim:

1. A method for a temporary attachment of a covering on a base, comprising the steps of:

treating a base for supporting a covering with a material containing a magnetically-attaching particulate material, said base being furnished with a web-like attachment sheet including a magnetically-attaching particulate material in the form of a foil, a non-woven material or a fabric, said web-like attachment sheet being a two-layer attachment sheet in which said magnetically-attaching particulate material is arranged between the two layers and is secured in place by means of an adhesive or a binding material;

producing the covering for attachment to the base so that the covering contains a magnetically-attaching particulate material, the magnetic attaching particulate material of the covering being different from the particulate material of the base so that the covering and the base are magnetically-attracted to one another; and, placing a side Of the covering against the base so that the covering is temporarily attached to the base by magnetic attraction between the magnetically-attaching particulate material of said cover and the magnetically-attaching particulate material of said base without adhesive means.

2. The method according to claim 1, wherein during the step of producing said covering, said covering is formed with at least two layers with a face layer in the form of a carpet and, at least one support layer having an outer layer with the magnetically-attaching particulate material being integrated in the support layer.

3. The method according to claim 1, wherein said attachment sheet is provided with knobs and the base is provided with holes into which the knobs are fitted.

4. The method according to claim 1, wherein the magnetically-attaching particulate material of the base is rendered electrically conducting.

5. The method according to claim 1, wherein ferromagnetic iron powder is used as said magnetically-attaching particulate material in said base or in said covering.

6. The method according to claim 1, wherein said magnetically-attaching particulate material of said base or said covering is selected from the group consisting of barium ferrite powder, strontium ferrite powder and a combination thereof, said magnetically-attaching particulate material being incorporated into said base or into said covering and then being permanently magnetized.

7. A method for a temporary attachment of a covering on a base, comprising the steps of:

treating a base for supporting a covering with a material containing a magnetically-attaching particulate material, said base being provided with a precoat into which said magnetically-attaching particulate material is integrated, said base having an attachment sheet provided with knobs with the base being provided with holes into which the knobs are fitted;

producing the covering for attachment to the base so that the covering contains a magnetically-attracting particulate material or a magnetic attraction particulate, the particulate of the covering being different from the particulate of the base so that the covering and the base are magnetically-attracted to one another; and, placing a side of the covering against the base so that the covering is temporarily attached to the base by magnetic attraction between the magnetically-attaching particulate material of said cover and the magnetically-attaching particulate material of said base without adhesive means.

8. The method according to claim 7, wherein during the step of producing said covering, said covering is formed with at least two layers with a face layer in the form of a carpet and, at least one support layer having an otter layer with the magnetically-attaching particulate material being integrated in the support layer.

9. The method according to claim 7, wherein the magnetically-attaching particulate material of the base is rendered electrically conducting.

10. The method according to claim 7, wherein ferromagnetic iron powder is used as said magnetically-attaching particulate material in said base or in said covering.

11. The method according to claim 7, wherein said magnetically-attaching particulate material of said base or said covering is selected from the group consisting of barium ferrite powder, strontium ferrite powder arid a combination thereof, said magnetically-attaching particulate material being incorporated into said base or into said covering and then being permanently magnetized.

12. A method for a temporary attachment of a covering on a base, comprising the steps of:

treating a base for supporting a covering with a material containing a magnetic-attaching particulate material, said base being provided with a surfacing material and having a precoat applied thereto in which the magnetically-attaching material is integrated;

producing the covering for attachment to the base so that the covering contains a magnetically-attaching particulate material, the magnetically-attaching particulate material of the covering being different from the particulate material of the base so that the covering and the base are magnetically-attracted to one another; and, placing a side of the covering containing the magnetically-attaching particulate material against the base containing the magnetically-attaching particulate material subject to a magnetic attraction so that the covering is temporarily attached to the base without adhesive means.

13. The method according to claim 12, wherein during the step of producing said covering, said covering is formed with at least two layers with a face layer in the form of a carpet and, at least one support layer having an outer layer with the magnetically-attaching particulate material being integrated in the support layer.

14. The method according to claim 12, wherein the magnetically-attaching particulate material of the base is rendered electrically conducting.

15. The method according to claim 12, wherein ferromagnetic iron powder is used as a magnetically-attaching particulate material in said base or in said covering.

16. The method according to claim 12, wherein said magnetically-attaching particulate material of said base or said covering is selected from the group consisting of barium ferrite powder, strontium ferrite powder and a combination thereof, said magnetically-attaching particulate material being incorporated into said base or into said covering and then being permanently magnetized.

17. A method for a temporary attachment of a covering on a base, comprising the steps of:

treating a base with a magnetically-attaching particulate material for supporting a covering, said base being provided with an attachment sheet containing magnetically-attaching particulate material in the form of a foil, a non-woven material or a fabric, with said attachment sheet having knobs and said base having holes into which the knobs are fitted;

producing a covering for attachment to the base so that the covering contains a magnetically-attaching particulate material, the particulate material of the covering being different from the particulate material of the base so that the covering and the base are magnetically-attracted to one another, said covering further comprising, at least one support layer having an outer layer with the magnetically-attaching particulate material being integrated in the support layer; and, placing a side of the covering against the base so that the covering is temporarily attached to the base by magnetic attraction between the magnetically-attaching particulate material of said cover and the magnetically-attaching particulate material of said base without adhesive means, wherein said base and said covering have said magnetically-attaching particulate material evenly dispersed across respective adjacent surfaces.

18. The method according to claim 17, wherein said attachment sheet is a two-layer attachment sheet in which said magnetically-attaching particulate material is arranged between the two layers and is secured in place by means of an adhesive or a binding material.

19. The method according to claim 17, wherein said base is provided with a surfacing material, in which magnetically-attaching particulate material is integrated.

20. The method according to claim 17, wherein said base is provided with a precoat and in which the magnetically-attaching particulate material is integrated.

21. The method according to claim 17, wherein the magnetically-attaching particulate material of the base is rendered electrically conducting.

22. The method according to claim 17, wherein ferromagnetic iron powder is used as said magnetically-attaching particulate material in said base or in said covering.

23. The method according to claim 17, wherein said magnetically-attaching particulate material of said base or said covering is selected from the group consisting of barium ferrite powder, strontium ferrite powder and a combination thereof, said magnetically-attaching particulate material being incorporated into said base or into said covering and then being permanently magnetized.

* * * * *